US010534304B2

(12) United States Patent
Terakado et al.

(10) Patent No.: US 10,534,304 B2
(45) Date of Patent: Jan. 14, 2020

(54) IMAGE FORMING APPARATUS

(71) Applicant: FUJI XEROX CO., LTD., Tokyo (JP)

(72) Inventors: Yuki Terakado, Kanagawa (JP); Shin Honda, Kanagawa (JP); Hidekazu Amamoto, Kanagawa (JP); Hiroki Ando, Kanagawa (JP); Takashi Akaike, Kanagawa (JP); Yuichi Sono, Kanagawa (JP); Satoru Ishii, Kanagawa (JP); Kazunori Shindo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/913,932

(22) Filed: Mar. 7, 2018

(65) Prior Publication Data

US 2019/0064725 A1 Feb. 28, 2019

(30) Foreign Application Priority Data

Aug. 22, 2017 (JP) ..... 2017-159458

(51) Int. Cl.
*B65H 29/52* (2006.01)
*G03G 15/00* (2006.01)
(Continued)

(52) U.S. Cl.
CPC ..... *G03G 15/6552* (2013.01); *B65H 29/26* (2013.01); *B65H 29/52* (2013.01); *B65H 31/00* (2013.01); *B65H 31/26* (2013.01); *B65H 2301/42146* (2013.01); *B65H 2404/61* (2013.01); *B65H 2404/74* (2013.01); *B65H 2404/743* (2013.01); *B65H 2405/214* (2013.01); *B65H 2405/22* (2013.01);
(Continued)

(58) Field of Classification Search
CPC .... B65H 29/52; B65H 31/26; B65H 2404/61; B65H 2404/74; B65H 2404/743; B65H 2405/20; B65H 2405/21; B65H 2405/214; B65H 2405/22; B65H 2301/42146
See application file for complete search history.

(56) References Cited

U.S. PATENT DOCUMENTS 4,065,123 A * 12/1977 Arrasmith ..... B65H 31/06 271/178
4,456,239 A * 6/1984 Yamaguchi ..... B65H 33/16 250/589
(Continued)

FOREIGN PATENT DOCUMENTS

JP 2005-316084 11/2005

*Primary Examiner* — Jeremy R Severson
(74) *Attorney, Agent, or Firm* — JCIPRNET

(57) ABSTRACT

An image forming apparatus includes: a transport member that transports a medium; a storage that is disposed below the transport member in a gravitational direction, and that stores the medium which is delivered by the transport member and falls into the storage; a supporter that is provided in the storage, and that has an upper end disposed below the transport member in a gravitational direction, and that allows the medium to be stored with a front end of the medium in a discharge direction matching a lower end of the medium in a gravitational direction; and a guidance member that is disposed in the supporter with the medium interposed between the guidance member and the supporter, and that guides the medium which falls to the supporter.

4 Claims, 6 Drawing Sheets

(51) Int. Cl.
*B65H 29/26* (2006.01)
*B65H 31/00* (2006.01)
*B65H 31/26* (2006.01)

(52) U.S. Cl.
CPC ..... *G03G 2215/00012* (2013.01); *G03G 2215/00421* (2013.01); *G03G 2215/00675* (2013.01)

(56) References Cited

U.S. PATENT DOCUMENTS 4,541,173 A * 9/1985 Sakuma ..... G03B 42/045 29/806
4,858,909 A * 8/1989 Stemmle ..... B65H 29/14 271/184
5,172,905 A * 12/1992 Vanous ..... G03B 17/32 271/1
6,065,746 A * 5/2000 Tranquilla ..... B65H 29/68 193/32
6,496,670 B1 * 12/2002 Ishikita ..... B41J 29/46 399/107
7,644,918 B2 * 1/2010 Peulen ..... B65H 29/14 271/198
8,201,816 B2 * 6/2012 Stauber ..... B65H 29/003 270/52.14
9,096,404 B2 * 8/2015 Duchstein ..... B65B 5/106

* cited by examiner

IMAGE FORMING APPARATUS

CROSS-REFERENCE TO RELATED APPLICATIONS

This application is based on and claims priority under 35 USC 119 from Japanese Patent Application No. 2017-159458 filed Aug. 22, 2017.

BACKGROUND

Technical Field

The present invention relates to an image forming apparatus.

SUMMARY

According to an aspect of the invention, there is provided an image forming apparatus including: a transport member that transports a medium; a storage that is disposed below the transport member in a gravitational direction, and that stores the medium which is delivered by the transport member and falls into the storage; a supporter that is provided in the storage, and that has an upper end disposed below the transport member in a gravitational direction, and that allows the medium to be stored with a front end of the medium in a discharge direction matching a lower end of the medium in a gravitational direction; and a guidance member that is disposed in the supporter with the medium interposed between the guidance member and the supporter, and that guides the medium which falls to the supporter.

BRIEF DESCRIPTION OF THE DRAWINGS

Exemplary embodiments of the present invention will be described in detail based on the following figures, wherein.

DETAILED DESCRIPTION

Figure 1:
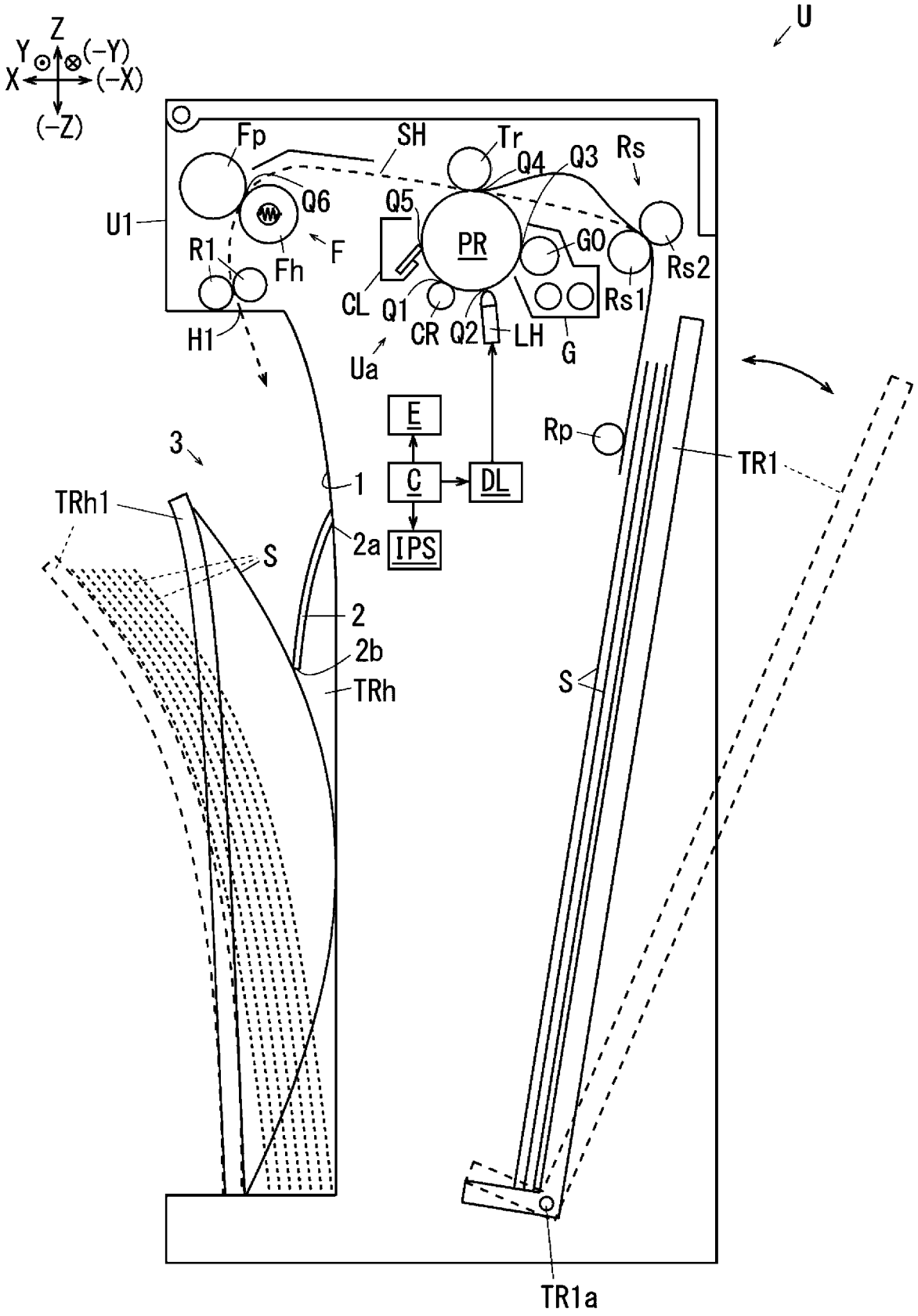
FIG. 1 is an explanatory diagram of an entire image forming apparatus according to a first exemplary embodiment.

Next, examples as specific instances of exemplary embodiments of the invention will be described with reference to the drawings. However, the invention is not limited to the following embodiments.

In order to facilitate the understanding of the following description, it is assumed in the drawings that the X-axis direction indicates the front-back direction, the Y-axis direction indicates the horizontal direction, and the Z-axis direction indicates the vertical direction. The directions or sides indicated by arrows X, −X, Y, −Y, Z, −Z are the forward, backward, rightward, leftward, upward, and downward directions or the front-side, back-side, right side, left-side, upper-side, and lower-side, respectively.

Also, in the drawings, the symbol of "○" with "•" inside indicates an arrow pointing from the far-side to the near-side of the paper surface, and the symbol of "○" with "x" inside indicates an arrow pointing from the near-side to the far-side of the paper surface.

It is to be noted that in the following description using the drawings, members other than the members necessary for description are not illustrated as appropriate to facilitate the understanding.

[First Exemplary Embodiment]

FIG. 1 is an explanatory diagram of an entire image forming apparatus according to a first exemplary embodiment.

In FIG. 1, in a printer U as an example of an image forming apparatus according to the first exemplary embodiment of the invention, a discharge tray TRh, which is an example of a discharger for medium and serves as an example of a storage, is disposed on a front portion.

The printer U in the first exemplary embodiment has a controller C as an example of a controller. The controller C is electrically connected to an image processor IPS, a laser drive circuit DL as an example of a latent image forming circuit, and a power supply circuit E. Therefore, the controller C can output a control signal to the image processor IPS and other circuits.

A photoreceptor PR as an example of an image retainer is supported in an upper portion of the printer U. A charging roller CR, a latent image forming device LH, a developing device G, a transfer roller Tr as an example of a transfer unit, and a photoreceptor cleaner CL as an example of a cleaner for image retainer are disposed in a rotational direction of the photoreceptor PR around the photoreceptor PR.

The latent image forming device LH in the first exemplary embodiment is formed of so-called LED head that is a device in which a light emitting diode (LED) as an example of a latent image writing device is linearly disposed with a predetermined interval in the horizontal direction.

In the developing device G, a developing roller G0 as an example of a developer retainer is disposed to be opposed to the photoreceptor PR.

Also, in the first exemplary embodiment, the photoreceptor PR, the charging roller CR, the developing device G, the latent image forming device LH, and the photoreceptor cleaner CL are unitized and integrally replaceable and detachable from the printer U.

In FIG. 1, a paper feed tray TR1 as an example of the storage of medium is disposed in the back of the printer U. The paper feed tray TR1 in the first exemplary embodiment is more inclined forward at a lower portion. Therefore, the lower portion of the paper feed tray TR1 is disposed to slide into the lower side the photoreceptor PR. Thus, the paper feed tray TR1 in the first exemplary embodiment is configured to store a sheet S as an example of medium in a standing state in the gravitational direction. The paper feed tray TR1 is movably supported around a rotational center TR1*a* at the lower end between a storage position indicated by a solid line of FIG. 1, and an open position with a smaller inclination angle than the inclination angle of the storage position, indicated by a dashed line of FIG. 1. Thus, in a state where the paper feed tray TR1 is moved to the open position, the sheet S can be supplied to the paper feed tray TR1 through an opening at the upper end of the paper feed tray TR1. It is to be noted that the paper feed tray TR1 in the first exemplary embodiment is held at the storage position by the magnetic force of a magnet member (not illustrated) as an example.

In the front side of the paper feed tray TR1, a pickup roller Rp as an example of a medium pickup member is disposed.

A handling roller Rs as an example of a medium handling member is disposed above the pickup roller Rp. The handling roller Rs is an example of a paper feed member, and has a feed roller Rs1 as an example of a first deliver member, and a retard roller Rs2 which is an example of a separating member and serves as an example of a second delivery member.

Delivery units Rp, Rs in the first exemplary embodiment are formed by the pickup roller Rp and the handling roller Rs.

A fixing device F is disposed forwardly of a transfer area Q4 in which the photoreceptor PR and the transfer roller Tr are opposed to each other. The fixing device F has a lower-side heat roller Fh as an example of a heat fixing member, and an upper-side pressure roller Fp as an example of a pressure fixing member. A fixing area Q6 is formed by a contact area of the pair of fixing rollers Fh, Fp.

A recording unit Ua in the first exemplary embodiment includes the photoreceptor PR, the charging roller CR, the developing device G, the latent image forming device LH, the transfer roller Tr, the photoreceptor cleaner CL, and a fixing device F.

A discharge roller R1 as an example of a discharge member is disposed below the fixing device F. A discharge outlet H1 as an example of an opening is formed below the discharge roller R1.

The discharge tray TRh as an example of the discharger is disposed below the discharge outlet H1 and forwardly of the printer U. The discharge tray TRh in the first exemplary embodiment is supported by a sheet support plate TRh1 as an example of a supporter. The sheet support plate TRh1 supports the sheet S on the front side (the outer side of the printer U as viewed in the horizontal direction) of the printer U, and is formed in a plate-like shape with an lower end fixedly supported, the plate-like shape extending upward. Also, the upper end of the sheet support plate TRh1 is disposed below the discharge roller R1 in the gravitational direction. Thus, the discharge tray TRh extends in the gravitational direction, and is configured to store the sheet S discharged through the discharge outlet H1 in a standing state in the gravitational direction.

In FIG. 1, the printer U in the first exemplary embodiment, a transport path SH of the sheet S from the paper feed tray TR1 to the discharge tray TRh through the transfer area Q4 is formed in a substantially inverted U-shape. Also, in the transport path SH in the first exemplary embodiment, a space having a width in the vertical direction with respect to the transport direction of the sheet S is ensured between the handling roller Rs and the transfer rollers Tr and between the transfer roller Tr and the fixing devices F to allow the sheet S to be slacked.

(Description of Image Forming Operation)

Print information is transmitted to the controller C of the printer U from a computer as an example of an external information transmitting device. When the controller C receives print information, an image forming operation is started. The controller C outputs the print information to the image processor IPS. The image processor IPS converts the print information to image information for latent image formation, and outputs the image information to the laser drive circuit DL as an example of an image writing circuit at a predetermined time, that is, a predetermined timing. The laser drive circuit DL outputs a driving signal to the latent image forming device LH according to the inputted image information.

When the image forming operation is started, the photoreceptor PR starts to rotate.

A charging voltage is applied to the charging roller CR from the power supply circuit E. In a charging area Q1 in which the charging roller CR and the photoreceptor PR are opposed to each other, the charging roller CR charges the surface of the photoreceptor PR.

The latent image forming device LH forms an electrostatic latent image according to the image information on the surface of the photoreceptor PR in a writing area Q2.

A developing voltage is applied from the power supply circuit E to the developing roller G0 of the developing device G. In a developing area Q3 in which the developing roller G0 and the photoreceptor PR are opposed to each other, the electrostatic latent image of the photoreceptor PR is developed to a visible image by the developer of the developing roller G0.

The pickup roller Rp delivers the sheet S stored in the paper feed tray TR1.

When the pickup roller Rp delivers multiple sheets S, the handling roller Rs separates the sheets one by one. The sheet S separated one by one by the handling roller Rs is transported to the transfer area Q4. It is to be noted that in the first exemplary embodiment, when the sheet S is transported, the handling roller Rs is driven for a predetermined period with the transfer roller Tr stopped. Therefore, the sheet S is slacked between the transfer roller Tr and the handling roller Rs with the leading end of the sheet S pressed against the transfer roller Tr. In other words, the sheet S forms a so-called loop. It is to be noted that in the printer U in the first exemplary embodiment, a loop is formed so that the sheet S is not pulled between a transport member on the upstream side and a transport member on the downstream side in the transport path SH. It is also possible to correct the inclination the so-called skew of the leading end of the sheet S by pressing the sheet S against the transfer roller Tr.

A transfer voltage is applied from the power supply circuit E to the transfer roller Tr. The transfer roller Tr transfers a toner image on the photoreceptor PR to the sheet S that passes through the transfer area Q4.

The photoreceptor cleaner CL removes remaining toner on the surface of the photoreceptor PR in a cleaning area Q5 as an example of a cleaning area set on the downstream side of the transfer area Q4.

The sheet S, on which a toner image is transferred in the transfer area Q4, is transported to the fixing device F with the toner image not fixed.

The fixing device F fixes the toner image on the surface of the sheet S transported to the fixing area Q6.

The discharge roller R1 discharges sheet S, on which the toner image is fixed, to the discharge tray TRh. The sheet S in the exemplary embodiment falls and is stored in the discharge tray TRh.

(Guidance Member)

In the discharge tray TRh, a guide film 2 as an example of a guidance member is disposed near the inner surface 1 opposed to the sheet support plate TRh1. The guide film 2 in the first exemplary embodiment is disposed at an upper portion of the inner surface 1. In the guide film 2, an upper base end 2*a* is supported by the inner surface 1, and a lower leading end 2*b* projects to the sheet support plate TRh1 and is disposed.

It is to be noted that in the printer U in the first exemplary embodiment, the discharge roller R1 and the transport path SH are formed so that the sheet S passing through the discharge outlet H1 is discharged in a direction inclined toward the inner surface 1 of the printer U with respect to the gravitational direction. The guide film 2 in the first exemplary embodiment is configured to have a length that allows the guide film 2 to come into contact with the sheet S discharged through the discharge outlet H1 and falls.

The leading end 2*b* of the guide film 2 in the first exemplary embodiment is disposed at a position corresponding to an upper portion of the discharged sheet S, and is disposed at a position lower than the upper end of the sheet S.

Also, the guide film 2 in the first exemplary embodiment is composed of polyethylene terephthalate (PET) as an example of a member having flexibility, however, any material such as plastic or rubber in a sheet form or a film form.

(Operation of First Exemplary Embodiment)

In the printer U in the above-described configuration in the first exemplary embodiment, when the sheet S is discharged to the discharge tray TRh through the discharge outlet H1, the guide film 2 comes into contact with the sheet S, and guides the sheet S to the sheet support plate TRh1. Therefore, the lower end of the sheet S is guided not toward the inner surface 1 but to the sheet support plate TRh1.

In a configuration not provided with the guide film 2, when the lower end of the sheet S is discharged to the inner surface 1, the lower end of the subsequently discharged sheet S is not likely to reach the bottom of the discharge tray TRh. In this case, the storage amount of the sheet S of the discharge tray TRh is reduced. In contrast, in the first exemplary embodiment, the sheet S is discharged through the discharge outlet Hi in a direction inclined to the inner surface 1, and is guided to the sheet support plate TRh1 by the guide film 2, and reduction in the storage amount of the sheet S is avoided.

When the stacked sheet S bends by its weight as illustrated in FIG. 1 or receives the wind of an air conditioner with standing in the discharge tray TRh, the inner surface 1 is likely to move to the upper end of the sheet S. In a configuration not provided with the guide film 2, when the discharged sheet S bends, the upper end of the sheet S may come into contact with the inner surface 1. In this state, although the subsequently discharged sheet S which is supposed to be discharged toward the inner surface 1 with respect to the already discharged sheet S, the subsequently discharged sheet S is discharged to the sheet support plate TRh1, and the order of storage, and the order of pages are mixed up.

In contrast, in the first exemplary embodiment, even when the upper end of the sheet S moves to the inner surface 1, the sheet S is supported by the guide film 2 disposed below the upper end of the sheet S, and movement of the sheet S to the inner surface 1 is regulated. Also, in this state, a substantially triangular space 3 pointing down is likely to be formed between an upper portion of the sheet S, the guide film 2, and the discharge outlet H1. When the space 3 is formed, the lower end of the subsequently discharged sheet S is reliably discharged to toward the inner surface 1 with respect to the already discharged sheet S. Thus, mix up of the order of storage, and the order of pages is reduced.

Also, the guide film 2 in the first exemplary embodiment has flexibility. Therefore, the amount of sheets S discharged to the discharge tray TRh is increased, and contact of the sheet S with the guide film 2 causes the guide film 2 to bend. Thus, an adverse effect on the amount of storage of the discharge tray TRh is reduced, as compared with a configuration in which the guide film 2 has no flexibility.

[Second Exemplary Embodiment]

Next, a second exemplary embodiment of the invention will be described, and in the description of the second exemplary embodiment, a component corresponding to a component of the first exemplary embodiment is labeled with the same symbol, and a detailed description is omitted.

This exemplary embodiment differs from the first exemplary embodiment in the points described below, however, is configured in the same manner as the first exemplary embodiment in other points.

Figure 2:
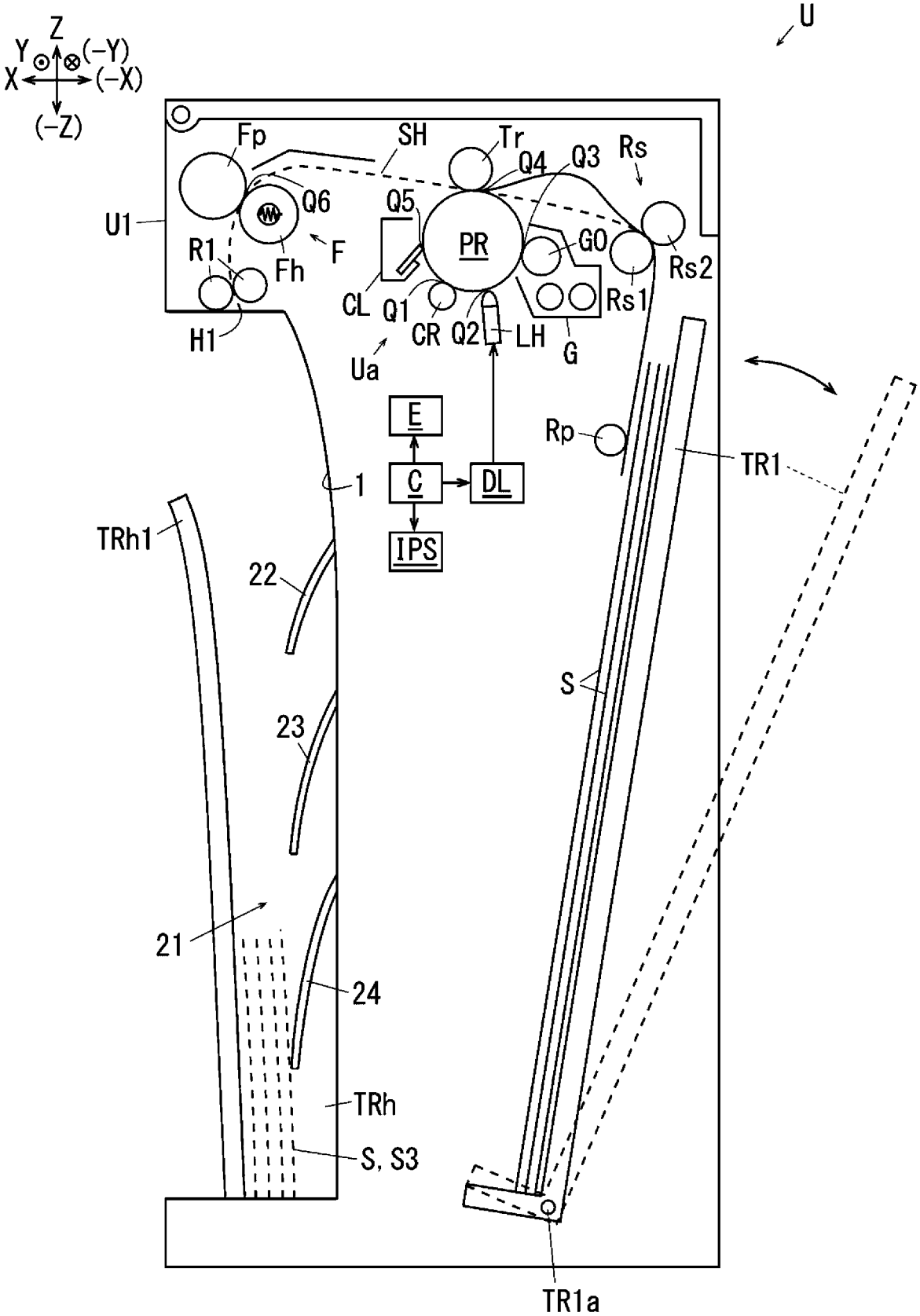
FIG. 2 is an explanatory diagram of a printer according to a second exemplary embodiment, and corresponds to FIG. 1 of the first exemplary embodiment.

FIG. 2 is an explanatory diagram of a printer according to the second exemplary embodiment, and corresponds to FIG. 1 of the first exemplary embodiment.

Figure 3:
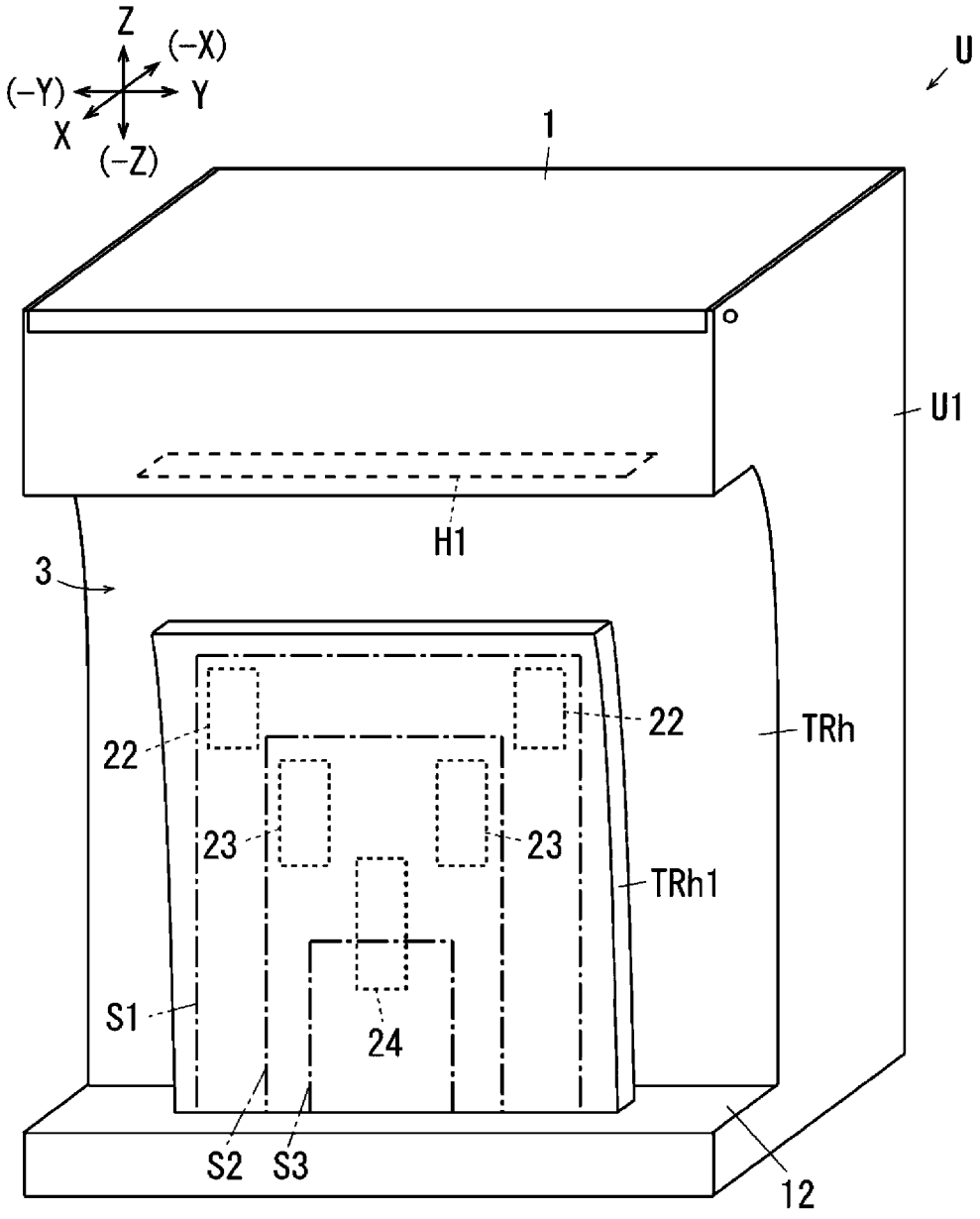
FIG. 3 is a perspective view of the printer according to the second exemplary embodiment from a diagonally front side.

FIG. 3 is a perspective view of the printer according to the second exemplary embodiment from a diagonally front side. In FIGS. 2 and 3, in the printer U according to the second exemplary embodiment, multiple guide members 21 each as an example of the guidance member are disposed with an interval in the gravitational direction, that is, in the direction in which the sheet S falls. The guide member 21 of Embodiment 2 in the second exemplary embodiment has a guide film 22 for a large size disposed at an upper portion of the inner surface 1, a guide film 23 for a medium size disposed below the guide film 22 for a large size, and a guide film 24 for a small size disposed below the guide film 23 for a medium size.

In FIG. 3, the guide film 22 for a large size is disposed corresponding to the upper portion and both corners of a large size sheet S1 in the width direction.

The guide film 23 for a medium size is disposed corresponding to the upper portion and both corners of a medium size sheet S2 in the width direction.

The guide film 24 for a small size is disposed corresponding to the upper portion and the central portion of a small size sheet S3 in the width direction.

In FIG. 3, in the guide member 21 in the second exemplary embodiment, each of the guide films 22 to 24 is disposed at a position opposed to the inner side of the sheet support plate TRh1.

In FIG. 2, for each of the guide films 22 to 24 of the guide member 21 in the second exemplary embodiment, the length from the base end to the leading end, the so-called free length is set longer for a guide film disposed lower. Specifically, the free length is set such that the free length of the guide film 22 for a large size<the free length of the guide film 23 for a medium size<the free length of the guide film 24 for a small size.

In FIG. 3, a pair of the guide films 22 for a large size is disposed with an interval in the width direction crossing the falling direction. Also, a pair of the guide films 23 for a medium size is disposed with an interval in the width direction. It is to be noted that in the second exemplary embodiment, the interval between the guide films 23 for a medium size is set smaller than the interval between the guide films 22 for a large size.

(Operation of Second Exemplary Embodiment)

In the printer U in the above-described configuration in the second exemplary embodiment, multiple guide films 22 to 24 are disposed in the discharge tray TRh according to the size of the sheet S. Also, multiple guide films 22 to 24 are disposed in the height direction as well as in the width direction. Therefore, even when the length and width of the sheet S discharged to the discharge tray TRh are varied, a substantially triangular space 3 is likely to be secured between an upper portion of the sheet S, the guide films 22 to 24, and the discharge outlet H1. Thus, mix up of the order of storage, and the order of pages is reduced, as compared with the case where the guide films 22 to 24 are not provided.

Figure 4:
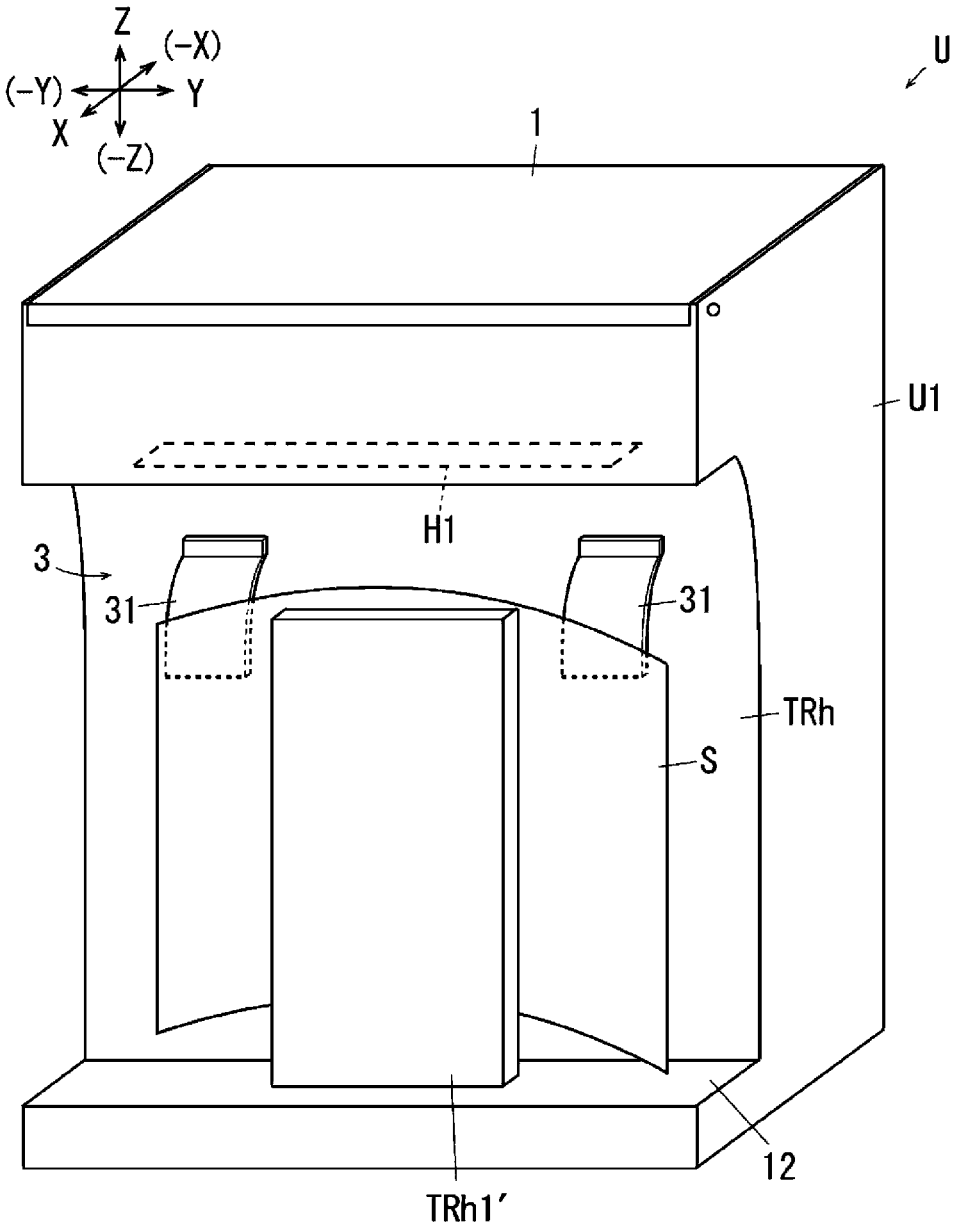
FIG. 4 is an explanatory diagram in the case where a guide member is not opposed to a sheet support plate.

FIG. 4 is an explanatory diagram in the case where a guide member is not opposed to a sheet support plate.

In FIG. 4, for instance, in a configuration in which the width of a sheet support plate TRh1' is narrow, the width between the guide films 31 may be wider than the width of the sheet support plates TRh1'. In the configuration, the guide films 31 are not opposed to the sheet support plate TRh1'. In the configuration, when the guide films 31 come into contact with the sheet S stored in a standing state, both sides of the sheet S in the width direction may receive a force from the guide films 31 and may be curved with respect to the width direction. Thus, the stacked sheet S may have a tendency to be curled.

In contrast, in the second exemplary embodiment illustrated in FIGS. 2 and 3, the guide films 22 to 24 are disposed inwardly of the width of the sheet support plate TRh1, and the guide films 22 to 24 are disposed to be opposed to the sheet support plate TRh1. Therefore, even when the sheet S comes into contact with the guide films 22 to 24, the sheet S is supported by the surface of the plate-like sheet support plate TRh1. Thus, a tendency of the sheet S to be curled is reduced.

Also, in the second exemplary embodiment, the guide films 22, 23 are disposed with an interval in the width direction. Although it is also possible to form the guide films by a single film extending in the width direction, when such single films are provided in multiple stages in the gravitational direction, when a user takes out the sheet S stored in the discharge tray TRh by a hand, a portion to be held by the hand is limited and it is difficult to take out the sheet S. In contrast, in the second exemplary embodiment, it is easy to take out the sheet S of the discharge tray TRh, as compared with the case where the guide films are formed by a single film.

In addition, in the second exemplary embodiment, in the guide films 22 to 24, the length is set longer for a guide film disposed lower. Here, when the sheet S is curved with respect to the height direction, in a situation where the horizontal width of the discharge tray TRh is the same, the bend, and curvature tend to be large for the sheet S with a shorter length in the height direction, as compared with the case where the sheet S has a longer length. Therefore, if the length of the guide film 24 for a small size is short, when the upper end of the sheet S falls to the inner surface 1, the sheet S does not come into contact with the guide film 24 for a small size, and may not be regulated. Consequently, in the second exemplary embodiment in which the length is set longer for a guide film disposed lower, the sheet S is likely to be guided to the sheet support plate TRh1, as compared with the case where the three guide films 22 to 24 have the same length, and thus movement of the upper end of the sheet S to the inner surface 1 is likely to be regulated.

[Third Exemplary Embodiment]

Next, a third exemplary embodiment of the invention will be described, and in the description of the third exemplary embodiment, a component corresponding to a component of the first exemplary embodiment is labeled with the same symbol, and a detailed description is omitted.

This exemplary embodiment differs from the first exemplary embodiment in the points described below, however, is configured in the same manner as the first exemplary embodiment in other points.

Figure 5:
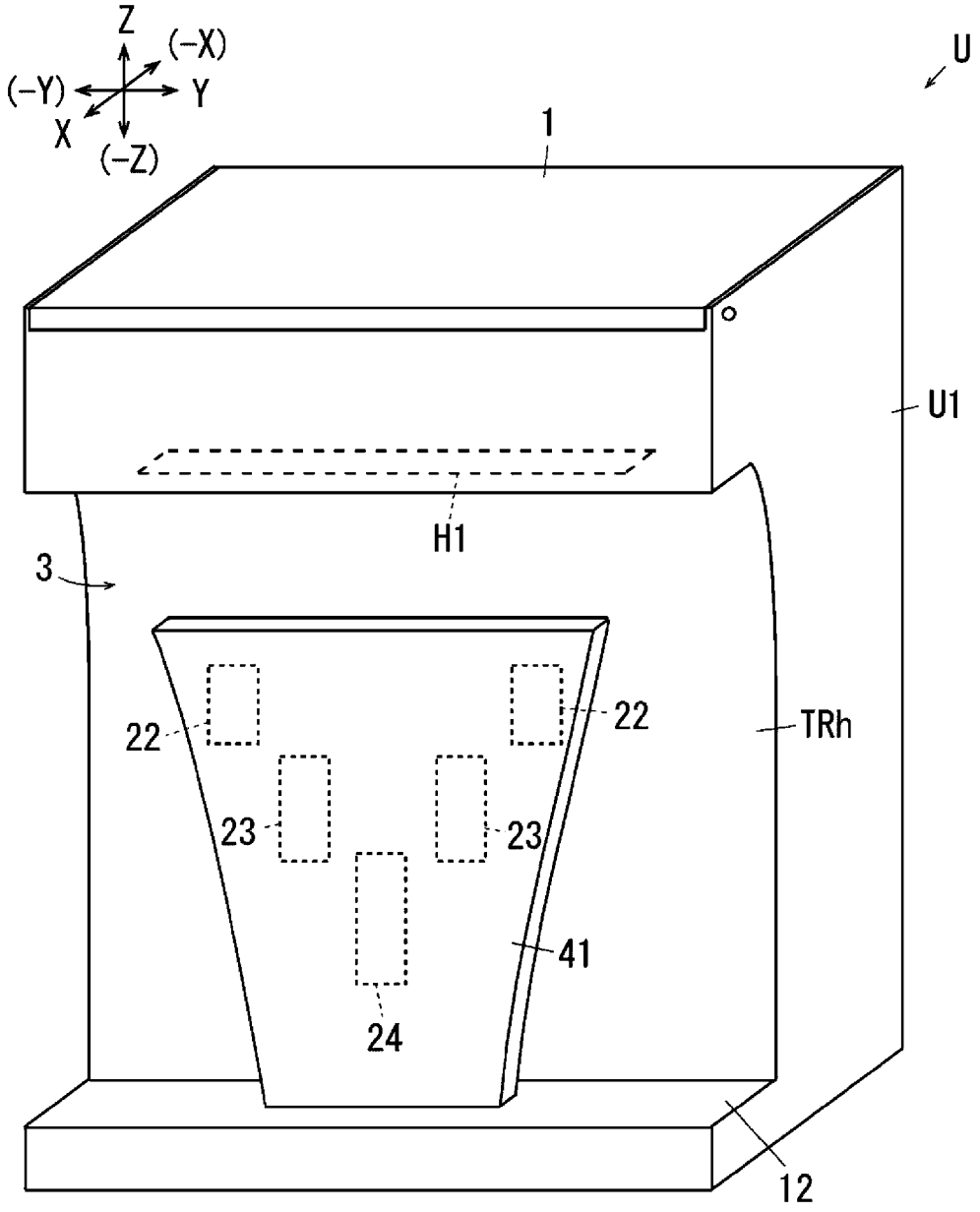
FIG. 5 is an explanatory diagram of a printer according to a third exemplary embodiment, and corresponds to FIG. 3 of the second exemplary embodiment.

FIG. 5 is an explanatory diagram of a printer according to a third exemplary embodiment, and corresponds to FIG. 3 of the second exemplary embodiment.

In FIG. 5, instead of a rectangular plate-like sheet support plate TRh1, a printer U in the third exemplary embodiment has a trapezoid-like sheet support plate 41 having a longer side on the upper base.

(Operation of Third Exemplary Embodiment)

In the printer U in the above-described configuration in the third exemplary embodiment, even with the trapezoid-like sheet support plate 41, the sheet S can be stored with the order of storage unlikely to be mixed up. In addition, the architectural performance, and the design performance can be improved, as compared with the rectangular plate-like sheet support plate TRh1.

Figure 6:
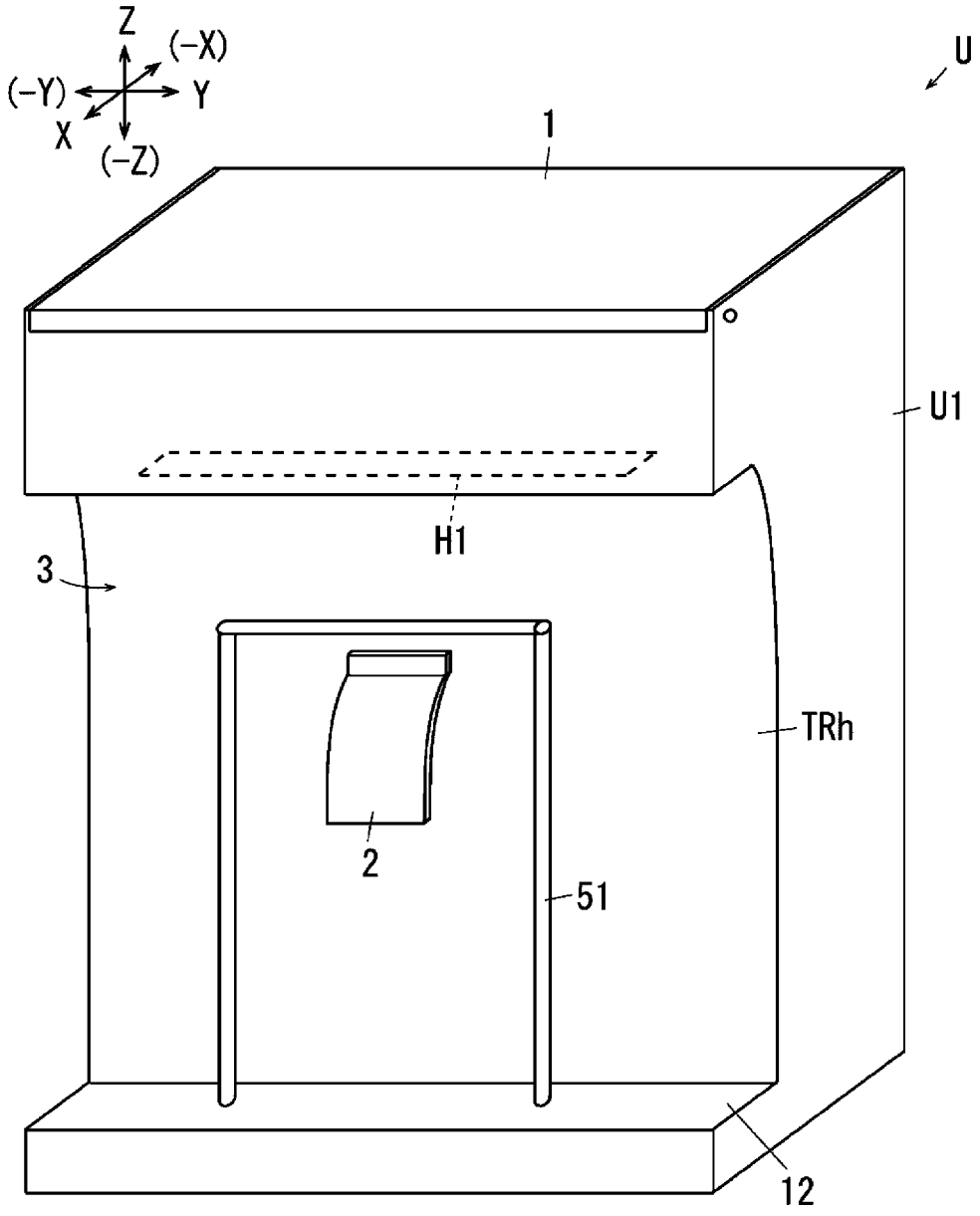
FIG. 6 is an explanatory diagram of a modification of the third exemplary embodiment.

FIG. 6 is an explanatory diagram of a modification of the third exemplary embodiment.

It is to be noted that the sheet support plate is not limited to the rectangular sheet support plate illustrated in the first exemplary embodiment, or the trapezoidal sheet support plate illustrated in the third exemplary embodiment. As illustrated in FIG. 6, the sheet support plate may be frame-shaped along an outer frame 51, or any shape according to the design and specification, such as a rhombus plate shape, a circular plate shape, an elliptical plate shape, and a shape combined with circles and polygons.

(Modifications)

Although the exemplary embodiments of the invention have been described above in detail, the invention is not limited to the aforementioned embodiments, and various modifications may be made within a scope of the gist of the invention described in the claims. The modifications (H01) to (H014) of the exemplary embodiments of the invention will be exemplified below.

(H01) Although the printer U as an example of the image forming apparatus has been exemplified in the exemplary embodiments, without being limited to this, the image forming apparatus may include, for instance, a copying machine, a facsimile, or a multifunctional device having some or all of these functions. Also, the image forming apparatus is not limited to an electrophotographic image forming apparatus, and the invention is applicable to any image forming apparatus, such as an inkjet or thermal image forming apparatus (that uses an ink ribbon or a thermal paper).

(H02) Although the printer U in a configuration, in which a monochromatic developer is used, has been exemplified, without being limited to this, the invention is applicable to an image forming apparatus supporting multiple colors more than one color, for instance.

(H03) The number and the positions (such as the height or the interval in the width direction) of the guide films 2, 22 to 24 in the exemplary embodiments are not limited to the configurations exemplified in the exemplary embodiments, and may be changed in any manner according to the design and specification.

(H04) Although it is desirable that the guide members be disposed at a position corresponding to the sheet support plate in the exemplary embodiments, part or all of the guide members may be disposed not to be opposed to the sheet support plate as illustrated in FIG. 4. Conversely, when the sheet S has a tendency to be curled in a process of passing through the fixing device F and the transport path SH at the time of image forming, the tendency to be curled may be corrected by the guide members.

(H05) Although it is desirable that the backside surfaces of the sheet support plate TRh1 and the discharge tray TRh be forwardly inclined at an upper positon in the exemplary embodiments, the backside surfaces may in the gravitational direction. Although it is desirable that the sheet support plate TRh1 be elastically deformable, the sheet support plate TRh1 may be elastically undeformable. In addition, although a configuration, in which the sheet support plate TRh1 is bendable, has been exemplified in the first and second exemplary embodiments, the invention is not limited to this. For instance, it is also possible to adopt a configuration in which the lower end of the sheet support plate TRh1 is rotatable and is provided with a gear so that the sheet support plate TRh1 is moved by rotating the gear.

(H06) Although it is desirable to adopt a configuration in which both right and left sides of the discharge tray TRh are open entirely in the vertical direction in the exemplary embodiments, a wall-shaped member, which covers part or all of the both right and left sides, may be disposed. Although it is desirable to adopt a configuration in which the space between the upper end of the sheet support plate TRh1 and the discharge outlet H1 is provided entirely in the horizontal direction, the space may be provided in part in the horizontal direction.

(H07) Although a configuration, in which the sheet S is discharged through the discharge outlet H1 in a direction inclined toward the inner surface 1, has been exemplified in the exemplary embodiments, the sheet S may be discharged in a direction inclined toward the sheet support plate TRh1.

(H08) Although it is desirable that the guide films 2, 22 to 24 have flexibility, the guide films 2, 22 to 24 may have no flexibility in the exemplary embodiments. For instance, the guide films 2, 22 to 24 may be integrally formed with the inner surface 1, and form projections from the inner surface 1.

(H09) Although the lengths of the guide films 2, 22 to 24 are set such that each leading end 2*b* comes into contact with the discharged sheet S in the exemplary embodiments, the lengths may be such that no contact occurs unless the sheet S bends in the gravitational direction.

(H010) Although a configuration, in which the bottom surface of the discharge tray TRh is formed horizontally, has been exemplified in the exemplary embodiments, the invention is not limited to this. For instance, the discharged sheet S can be guided forwardly by forming the bottom surface such that the bottom surface is inclined more downward at a more forward position.

(H011) Although a configuration, in which a loop is formed in the transport path SH, has been exemplified in the exemplary embodiments, the invention is not limited to this. It is also possible to adopt a configuration in which a loop is not formed.

(H012) The sheet S as an example of a medium is not limited to paper in the exemplary embodiments, and may be any thin medium having a surface on which an image can be recorded, such as a film or a card made of resin.

(H013) The paper feed tray TR1 is forwardly inclined at a lower positon in the exemplary embodiments, the invention is not limited to this. It is sufficient that the placing surface, for the sheet S, on the paper feed tray TR1 be in a direction having the gravitational direction as the main component, and the placing surface may be completely in the gravitational direction.

(H014) Although it is desirable that the guide films 2, 22 to 24 correspond to an upper portion of the sheet S, and be disposed at a position lower than the upper end of the sheet S in the exemplary embodiments, the invention is not limited to this. In order to set the upper end of the sheet S against the sheet support plate TRh1, in a range in which the sheet S can be guided, the guide films 2, 22 to 24 may be disposed at a central portion of the sheet S in the height direction, or at a position which is the same as or higher than the upper end of the sheet S.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport member that transports a medium;

a storage that is disposed below the transport member in a gravitational direction, and that stores the medium which is delivered by the transport member and falls into the storage;

a supporter that is provided in the storage, and that has an uppermost end disposed below the transport member in the gravitational direction, and that allows the medium to be stored with a front end of the medium in a discharge direction matching a lower end of the medium in the gravitational direction; and a plurality of guidance members that are disposed in the supporter with the medium interposed between the plurality of guidance members and the supporter, and that guide the medium which falls to the supporter, wherein the plurality of guidance members are disposed with an interval in a width direction crossing a falling direction of the medium, wherein the interval between the plurality of guidance members in the width direction at an upper position of the storage is wider than the interval between the plurality of guidance members in the width direction at a lower position of the storage according to a size of the medium.

2. The image forming apparatus according to claim 1, wherein each of the plurality of guidance members is disposed correspondingly to an upper portion of the medium stored in the storage in a height direction, and is disposed at a position lower than an upper end of the medium.

3. An image forming apparatus comprising:

a transport member that transports a medium;

a storage that is disposed below the transport member in a gravitational direction, and that stores the medium which is delivered by the transport member and falls into the storage;

a supporter that is provided in the storage, and that has an uppermost end disposed below the transport member in the gravitational direction, and that allows the medium to be stored with a front end of the medium in a discharge direction matching a lower end of the medium in the gravitational direction; and a plurality of guidance members that are disposed in the supporter with the medium interposed between the plurality of guidance members and the supporter, and that guide the medium which falls to the supporter, wherein the plurality of guidance members are disposed with an interval in a falling direction of the medium, wherein the guidance member disposed lower in the falling direction has a longer length of projection into the storage.

4. The image forming apparatus according to claim 1, wherein each of the plurality of guidance members is composed of a member having flexibility.

* * * * *